US010480212B2

(12) United States Patent
Buchmüller

(10) Patent No.: US 10,480,212 B2
(45) Date of Patent: Nov. 19, 2019

(54) WINDOW/DOOR SECURING DEVICE

(71) Applicant: ABUS August Bremicker Söhne KG, Wetter-Volmarstein (DE)

(72) Inventor: Eduard Buchmüller, Rehe (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 0 days.

(21) Appl. No.: 15/906,516

(22) Filed: Feb. 27, 2018

(65) Prior Publication Data

US 2018/0245369 A1 Aug. 30, 2018

(30) Foreign Application Priority Data

Feb. 28, 2017 (DE) ..... 10 2017 104 102

(51) Int. Cl.

| | |
|---|---|
| ***E05B 9/08*** | (2006.01) |
| ***E05B 65/06*** | (2006.01) |
| ***E05B 27/00*** | (2006.01) |
| ***E05C 1/02*** | (2006.01) |
| ***E05C 1/00*** | (2006.01) |
| ***E05B 63/00*** | (2006.01) |

(Continued)

(52) U.S. Cl.

CPC ..... *E05B 9/082* (2013.01); *E05B 9/08* (2013.01); *E05B 27/00* (2013.01); *E05B 63/0004* (2013.01); *E05B 63/0052* (2013.01); *E05B 63/04* (2013.01); *E05B 63/122* (2013.01); *E05B 65/06* (2013.01); *E05C 1/006* (2013.01); *E05C 1/02* (2013.01)

(58) Field of Classification Search

CPC ..... E05B 9/082; E05B 63/0004; E05B 9/08; E05B 63/122; E05B 63/04; E05B 63/0052; E05B 27/00; E05B 65/06; E05C 1/006; E05C 1/02

USPC ..... 70/2, 89, 91, 129, 370, 451, 461, 462, 70/466; 292/244, 281, DIG. 6, DIG. 20, 292/DIG. 53, DIG. 60

See application file for complete search history.

(56) References Cited

U.S. PATENT DOCUMENTS

| | | | | |
|---|---|---|---|---|
| 796,280 | A * | 8/1905 | Applegate | |
| 1,381,395 | A * | 6/1921 | Bock | E05B 63/127 70/116 |

(Continued)

FOREIGN PATENT DOCUMENTS

| | | | |
|---|---|---|---|
| DE | 1708009 | A1 | 11/1969 |
| DE | 8804633 | U1 | 7/1988 |

(Continued)

*Primary Examiner* — Lloyd A Gall

(74) *Attorney, Agent, or Firm* — Harness, Dickey & Pierce, P.L.C.

(57) ABSTRACT

A window/door securing device for securing a leaf, in particular an outwardly opening leaf, of a window or door in a closed position in which the leaf contacts a frame of the window or door comprises a base body and a counter-piece that is selectively latchable to the base body so that on a fastening of the base body to the frame and of the counter-piece to the leaf, the leaf can be secured in the closed position by latching the counter-piece to the base body. The base body has two installation surfaces so that one of the installation surfaces of the base body can be selectively placed on and fastened to the frame. In this respect, two installation surfaces are aligned perpendicular to one another.

32 Claims, 4 Drawing Sheets

(51) Int. Cl.
*E05B 63/04* (2006.01)
*E05B 63/12* (2006.01)

(56) References Cited

U.S. PATENT DOCUMENTS 1,398,636 A * 11/1921 Forlander ..... E05B 63/242 292/341.17
1,512,939 A * 10/1924 Ledin ..... E05B 9/082 70/134
1,584,950 A * 5/1926 Lanphere ..... E05B 63/123 292/190
1,812,988 A 7/1931 Segal
1,966,171 A * 7/1934 Holtzman ..... E05B 19/00 70/114
2,605,517 A * 8/1952 Rucker ..... E05D 13/06 160/102
2,730,970 A * 1/1956 Martin ..... E05B 45/04 109/32
3,078,704 A * 2/1963 Rifkin ..... E05B 65/0864 292/144
3,082,617 A * 3/1963 Kerman ..... E05B 65/0864 292/179
3,312,794 A * 4/1967 Hollyday ..... H01H 9/282 200/293
3,460,861 A * 8/1969 Niilola ..... E05B 67/383 292/281
3,580,017 A * 5/1971 Waldo ..... E05B 9/082 292/1.5
3,858,923 A * 1/1975 Bunn ..... E05B 67/383 292/281
4,138,150 A * 2/1979 Bills ..... E05B 65/0864 292/60
4,724,690 A * 2/1988 Dunphy ..... E05C 1/04 292/153
5,352,001 A * 10/1994 Shieh ..... E05B 15/025 292/341.18
6,601,417 B2 * 8/2003 Cowper ..... E05B 9/082 70/129
6,684,669 B1 2/2004 Talpe
6,688,656 B1 * 2/2004 Becken ..... E05B 65/0858 292/26
6,776,441 B2 * 8/2004 Liu ..... E05B 63/0013 292/24
6,981,724 B2 * 1/2006 Denys ..... E05B 63/24 292/64
7,261,342 B2 * 8/2007 Smith ..... E05B 63/20 292/137
7,640,772 B2 * 1/2010 Johnson ..... E05B 73/0005 114/172
2010/0123321 A1 * 5/2010 Timothy ..... E05B 1/0038 292/69

FOREIGN PATENT DOCUMENTS

DE 10101767 A1 7/2002
DE 102006047708 A1 4/2008
EP 2933410 A1 10/2015
GB 2301141 A 11/1996
GB 2441453 A 3/2008
WO WO-2014023310 A2 2/2014
WO WO-2015077827 A1 6/2015

* cited by examiner

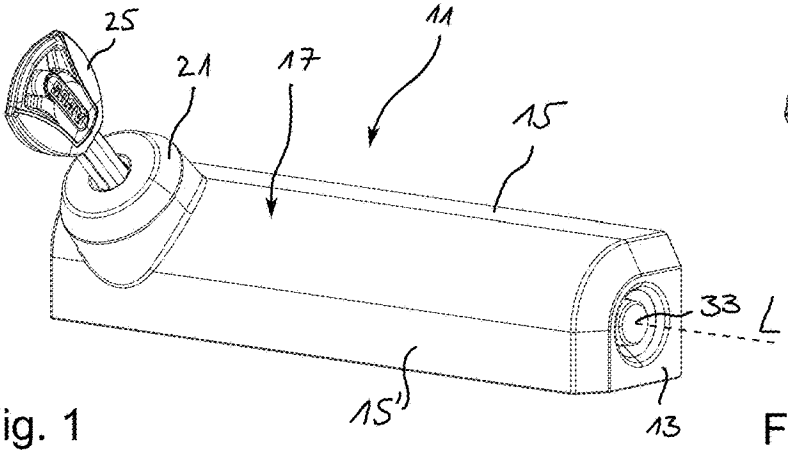
Fig. 1
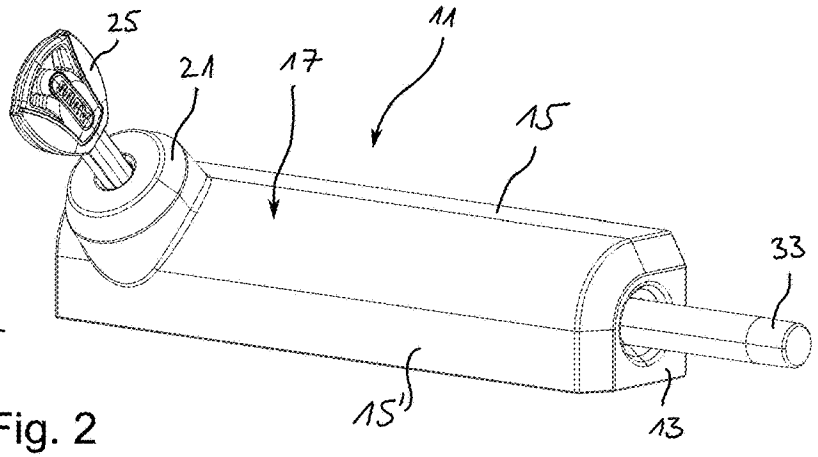
Fig. 2
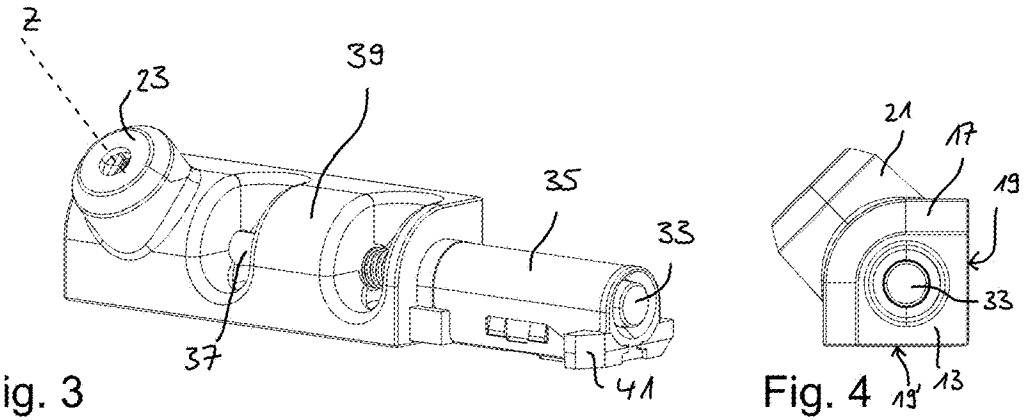
Fig. 3
Fig. 4
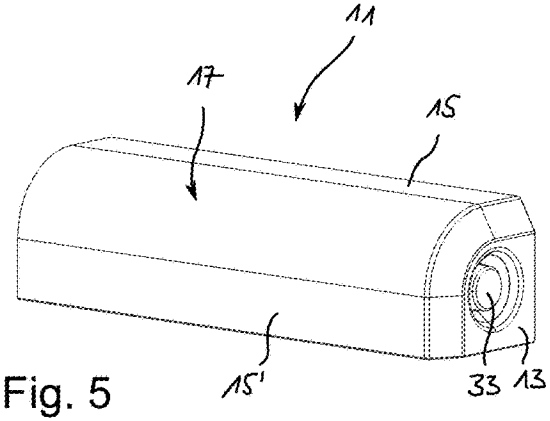
Fig. 5

WINDOW/DOOR SECURING DEVICE

BACKGROUND

The present invention relates to a window/door securing device for securing a leaf, in particular an outwardly opening leaf, of a window or door in a closed position in which the leaf contacts a frame of the window or door. The fitting provided for supporting the leaf at the frame admittedly as a rule already has a latching function. The security of the latching, in particular against a violent breaking open or prizing apart such as on a break-in, can, however, also be still substantially improved by the additional provision of one or more window/door securing devices. Window/Door securing devices are therefore typically only retroactively fitted to existing windows or doors.

A window/door securing device can, for example, comprise a base body and a counter-piece that is selectively latchable to the base body. On a fastening of the base body to the frame and of the counter-piece to the leaf, the leaf can be secured in the closed position by latching the counter-piece to the base body. It is advantageous here to provide the base body, that is heavier and more voluminous as a rule, at the frame and to provide the counter-piece, that is more compact as a rule, at the leaf.

The window/door securing device is expediently installed at an inner side of the window or door so that it is not directly accessible from the outside on an attempted break-in. With windows and doors that open inwardly, there is as a rule sufficient space for the fastening of the window/door securing device to the leaf and to the frame of the window or door. If the leaves are, however, opened outwardly, such as is widespread for windows in Scandinavia, the useful space for a fastening of the window/door securing device at the inner side of the frame and in particular of the leaf is very limited as a rule. This is due to the fact that the leaf contacts the fixed frame from the outside in the closed position so that a large part of the leaf frame is covered by the frame at the inside and is thus not available for a fastening of the door/window securing device. It must furthermore be considered with outwardly opening leaves that the part of the window/door securing device to be fastened to the inner side of the leaf may not project too far in order not to abut the frame on opening the leaf and thereby to block the opening.

The base body of the window/door securing device can be specifically configured for fastening to the frame and can in particular have an installation surface that is substantially planar to be able to be applied areally to a corresponding area of the frame. In addition, the installation surface can be configured for cooperation with fastening means such as screws by means of which the base body can be fastened to the frame. The possibilities of positioning and aligning the base body at the frame can, however, be limited by the shape, size and arrangement of such an installation surface.

An actuation element can be provided at the base body for releasing the counter-piece from the base body and, optionally, also for latching the counter-piece to the base body (which can, however, also take place automatically). The actuation element is then expediently at a position that is easily accessible for a person standing in front of the window or door on the arrangement of the base body in a predefined position and orientation. Such an ideal position of the actuation element can, however, e.g. depend on whether the respective leaf opens at the left (i.e. the hinges are at the right) or at the right (i.e. the hinges are at the left). If, for example, the window/door securing device is designed for an arrangement at a left-opening leaf, this window/door securing device cannot be attached to a right-opening leaf under certain circumstances or the actuation element is then located at a point that is difficult to access.

SUMMARY

It is an object of the invention to provide a window/door securing device that is especially suitable for installation at an inner side of outwardly opening windows or doors and can generally be installed and used particularly flexibly.

Advantageous embodiments result from the dependent claims, the following description and the drawings.

In accordance with the invention, the base body of the window/door securing device has two installation surfaces so that one of the installation surfaces of the base body can be selectively placed at and fastened to the frame, with the two installation surfaces being aligned perpendicular to one another. In other words, two installation surfaces are provided at the base body that can be selectively used for fastening the base body to the frame of the window or door and that extend at least substantially along a respective plane of extent, with these two planes of extent being aligned at an angle of 90° with respect to one another. For the installation of the base body at the frame, it is thus possible to choose with which of the two installation surfaces the base body should be fastened thereto. The mutually perpendicular alignment of the two installation surfaces makes it possible in this respect to install the window/door securing device at an angle between the frame and the leaf, with one installation surface then contacting the frame and the other installation surface contacting the leaf with a closed leaf so that the installation surface not used for the fastening of the base body can be used for cooperation with the counter-piece.

The angled alignment of the installation surfaces additionally makes possible a flexible positioning of the window/door securing device to a left-opening leaf and equally to a right-opening leaf since an alignment of the base body can substantially be maintained by a corresponding choice of the installation surface used for the fastening independently of whether the window/door securing device is attached at the left or at the right so that an actuation element optionally provided at the base body can also be accessible from the same direction in both cases. In addition, the direction from which the actuation element has to be actuated can be changed by the selection of the installation surface used for the fastening so that e.g. with a window/door securing device attached at the left, a free choice can be made whether the actuation element should be actuable from above or from below. It must be noted here that the window/door securing device cannot only be attached to vertical sides of a window or door, but equally at horizontal sides.

The two installation surfaces aligned perpendicular to one another can in particular be adjacent one another, whereby the window/door securing device can be formed in a particularly compact manner and can be fitted between the leaf and the frame. For the window/door securing device can be arranged at an angle between the frame and the leaf such that the one installation surface faces the frame and the other installation surface faces the leaf and the edge is seated low in the angle between the installation surfaces. It is furthermore advantageous in this respect if the window/door securing device has an elongate shape along a longitudinal axis in parallel with both installation surfaces, with the installation surfaces then preferably having a greater extent in the direction of the longitudinal axis than transversely thereto. The extent in the direction of the longitudinal axis is in particular at least twice as large, preferably at least three times as large, as the extent transversely to the longitudinal axis. Such a window/door securing device can then also be installed at particularly small angles between the frame and the leaf frame such as are in particular present with outwardly openings leaves.

In accordance with an advantageous embodiment, the two installation surfaces each have at least one screw leadthrough, preferably at least two screw leadthroughs, through which a respective screw can be guided for fastening the base body to the frame. The base body can in this manner be screwed to the frame through one of the installation surfaces. If this is done with at least two screws, the fastening is also secure against rotation.

It is furthermore advantageous if the base body is configured to be used as a drill template for the fastening of the counter-piece to the leaf while the base body is fastened to the frame. In other words, the base body is designed such that it can serve as a drill template for drilling the fastening holes for the counter-piece by holding at the frame and at the leaf. This contributes to a simple assembly of the window/door securing device. The counter-piece can, for example, in accordance with an advantageous further development, have one or more screw leadthroughs through which a respective screw can be led for fastening the counter-piece to the leaf, with the arrangement of the screw leadthroughs of the counter-piece corresponding to the arrangement of the screw leadthroughs of a respective installation surface of the base body. The fastening of the window/door securing device can then e.g. be carried out as follows. One of the installation surfaces of the base body is first placed at the frame at a suitable point, with the other installation surface facing the leaf. Bores for the screws can then be drilled into the frame through the screw leadthroughs of the installation surface contacting the frame or the screws can be screwed directly into the frame. The screw leadthroughs of the other installation surface of the base body that faces the leaf are then arranged so straight that bores for the screws fastening the counter-piece to the leaf can be drilled through them or so that at least the corresponding positions can be marked. The counter-piece can be exactly positioned in a simple manner in this way with the aid of the base body.

In accordance with a further advantageous embodiment, the base body has a receiver, that is a receiver space, for receiving a latch section of the counter-piece. In this respect, the base body and the counter-piece are expediently fastened to the frame or to the leaf such that the latch section of the counter-piece is received in the receiver of the base body in the closed position of the leaf. This makes it possible to latch the counter-piece to the base body in the closed position of the leaf in that the latch section in the receiver is blocked against a departure from the receiver. For this purpose, a latch that, for example, engages behind the latch section, as will be explained in the following, can be provided at the base body.

The base body preferably has a single, common receiver for receiving the latch section of the counter-piece independently of which of the two installation surfaces is used for the fastening of the base body to the frame.

In accordance with an advantageous further development, the two installation surfaces each have a receiver opening through which the latch section can penetrate into the receiver. A respective installation surface can thus alternatively be used, on the one hand, to fasten the base body to the frame and, on the other hand, to latch the counter-piece in the base body in that the installation surface provides a receiver opening through which the latch section of the counter-piece can move into the receiver where it is can then be latched. If the one installation surface is used for the fastening, the other installation surface is available for cooperation with the counter-piece, and vice versa. In other words, when the one of the two installation surfaces of the base body is fastened to the frame of the window or door, the receiver opening of the other one of the two installation surfaces can lie free so that the latch section of the counter-piece can penetrate through this exposed receiver opening into the receiver of the base body. The fact that it is not fixed in advance which installation surface serves for the fastening and which installation surface cooperates with the counter-piece contributes to the flexibility of use of the window/door securing device.

In accordance with a further advantageous further development, the receiver opening is arranged, in particular centrally, between two screw leadthroughs of the respective installation surface. The screw leadthroughs and the receiver opening can, for example, be arranged distributed along a longitudinal axis of the window/door securing device, with the receiver opening being disposed between two screw leadthroughs. In particular when the two installation surfaces are formed as symmetrical with one another, the window/door securing device is formed in a particularly stable manner in such an embodiment. For then the receiver for receiving the latch section of the counter-piece is located in a region between two screw leadthroughs via which the base body is fastened to the frame. If the counter-piece is latched to the base body, forces that act in the direction of a release of the counter-piece from the base body are transmitted via the latch section in the region of the receiver onto the base body and can be led off to the frame from there, in particular symmetrically, at both sides via a respective screw connection. The forces can in this manner be absorbed particularly easily by the frame. Torques are additionally in particular avoided that could otherwise act in the direction of a release of the base body from the frame.

It is also advantageous independently of the above-described arrangement of a receiver opening between two screw leadthroughs of a respective installation surface if the two installation surfaces are formed symmetrically with respect to one another, in particular with respect to the position of respective screw leadthroughs and/or receiver openings. For such a symmetry contributes to it functionally making no difference which of the installation surfaces is selected for the fastening of the base body to the frame and which is selected for the cooperation with the counter-piece. Since thus neither of the two possibilities is preferred over the other, the window/door securing device can be installed particularly flexibly to the window or door substantially only with regard to a desired position and alignment. The two installation surfaces can in particular be formed symmetrical to one another with respect to a plane that extends at a 45° angle to each of the two installation surfaces.

In accordance with a preferred embodiment, the window/door securing device comprises a latch which is movably supported at the base body between a release position and a latching position and via which the counter-piece can be latched to the base body.

The latching of the counter-piece to the base body can here in particular take place in that a latch section of the counter-piece is received in a receiver formed at the base body in the closed position of the leaf and in that the latch blocks the latch section of the counter-piece in the receiver in the latching position, preferably blocks it with shape matching, for example by an engaging behind of the latch section. The receiver named here and the latch section named here can in particular correspond to the above-described receiver or to the above-described latch section. Such a cooperation of a latch supported at the base body with a latch section of the counter-piece enables a simple, but reliable latching of the counter-piece to the base body. Since the blocking of the latch section by the latch takes place within a receiver for the latch section in the base body, the latch can be supported particularly easily and the latch section can be particularly easily spatially restricted against an escape from a blocking engagement or engaging behind, which contributes to the reliability of the latching.

In accordance with an advantageous further development, the latch is aligned and/or movable in parallel with the two installation surfaces. The latch is preferably formed as an elongate pin whose longitudinal extent is aligned and movable in parallel with the installation surfaces. The latch can be movably supported in a straight line. Such a latch can be particularly easily integrated into a window/door securing device that is correspondingly formed as elongate so that it can be formed as compact overall. The reception of the latch section of the counter-piece in the receiver of the base body in particular takes place through a receiver opening formed in the respective installation surface and thus at least substantially perpendicular to the respective installation surface. The latch that is movable in parallel with the installation surface consequently blocks, in particular engages behind, the latch section of the counter-piece perpendicular to its direction of movement, which additionally contributes to the reliability of the latching.

In accordance with a further advantageous further development, the latch is arranged in the latching position such that it blocks screws that are guided through screw leadthroughs of the installation surfaces and by which the base body is fastened to the frame against a release. In other words, the latch can be arranged at the base body such that the latch covers at least one screw leadthrough of the respective installation surface in the latching position. This can in particular result from the fact that the axes of the screw leadthroughs which are aligned perpendicular to the respective installation surface and along which screws led through the screw leadthrough are aligned intersect the latch located in the latching position. If the latch is arranged close enough to the installation surfaces, in particular at a spacing that is smaller than the length of the used screws, the screws are therefore blocked by the latch against a removal from the respective screw leadthrough. With a sufficiently small spacing, the screw heads can furthermore be covered by the latch such that the cannot be reached by a screwdriver. In this way, the latch not only latches the counter-piece to the base body in the latching position, but rather also secures the installed window/door securing device against unauthorized release.

It is furthermore advantageous if the window/door securing device comprises a locking mechanism that is arranged at the base body and is configured to selectively block the latch against a movement into the release position in the latching position. Such a locking mechanism can secure the latch against unauthorized actuation in that it blocks the latch in the latching position and only releases it for a movement into the release position when the locking mechanism is released. The locking mechanism can here preferably only be released by someone and the latch can thus only be released by someone who has a specific locking secret that can, for example, be a numerical code or a key.

If such a locking mechanism is provided, a further latching position that the latch can adopt in a stable manner, but without being able to be blocked by the locking mechanism, can be defined in addition to the latching position in which the latch can be blocked by the locking mechanism. In the further latching position, the latch section of the counter-piece is in this respect as in said latching position prevented from departing from the receiver of the base body by the latch so that the counter-piece is also secured to the base body in the further latching position. In addition, screws used for fastening the base body can advantageously also by blocked by the latch against a release in the further latching position.

The functional difference between said latching position and the further latching position to this extent substantially comprises only said latching position, but not also the further latching position additionally being able to be blocked by the locking mechanism for an improved security. The further latching position here is preferably between the release position and said blockable latching position of the latch. In this manner, a choice can be made in dependence on the security requirement whether the latch is displaced from the release position only into the further latching position to latch the counter-piece to the base body, with this latching being able to be comfortably released again without a locking secret or whether it is furthermore displaced into the blockable latching position to additionally secure the latching by the locking mechanism against unauthorized release. The blocking of the latch in the blockable latching position here preferably takes place automatically on a reaching of the blockable latching position, which can, for example, be achieved in that the locking mechanism is preloaded into a state blocking the latch.

In accordance with an advantageous further development, the locking mechanism comprises a lock cylinder whose cylinder axis is aligned at an angle of 45° with respect to the two installation surfaces. The cylinder axis can in particular correspond to an axis of rotation of a rotatable cylinder core of the lock cylinder. The lock cylinder can be actuable by means of an associated key to release the block of the latch. The key introduction direction is then aligned in parallel with the cylinder axis of the lock cylinder and is thus likewise aligned at an angle of 45° to the two installation surfaces. If the window/door securing device was installed at an angle between the frame and the leaf, the lock cylinder or the key thus projects from the window/door securing device in the direction of the bisectrix. The key is thereby also easily accessible under tight spatial conditions, whereby the operation of the window/door securing device is simplified.

The lock cylinder is preferably a lock cylinder having disk tumblers. A lock cylinder of this type admittedly only enables a restricted angle of rotation (in comparison with a lock cylinder having pin tumblers, for example). A restricted angle of rotation can, however, be sufficient to block said latch in the latching position and it can simultaneously offer better protection against so-called picking. In addition, such a lock cylinder enables a plurality of different locking codes (i.e. different locking secrets to which the lock cylinder can be coded) with a comparatively compact configuration, in particular with respect to the extent in the direction of the cylinder axis.

In accordance with a further advantageous embodiment, the window/door securing device has an actuation mechanism via which the latch can be displaced in the manner of the ink cartridge of a ball point pen. The latch can then, for example, be preloaded in the direction of the release position and can be displaced out of the release position in the direction of the latching position and slightly beyond it by pressing an actuation pin. If it is displaced so far, a bounding abutment is activated that blocks a return of the latch into the release position driven by the preload and thereby holds the latch in the latching position. If the latch is subsequently again slightly displaced beyond the latching position by a pressing of the actuation pin out of the latching position, the bounding abutment is thereby deactivated again so that the latch is again subsequently displaced back into the release position by the preload. Such a mechanism enables a particularly intuitive and comfortable actuation of the latch. In addition, the latching status of the latch can be directly read off at the position of the actuation pin.

It is advantageous from a construction aspect here if the actuation mechanism can be clipped onto the base body. Latching means can be provided for this purpose that latch in when the actuation mechanism is pressed onto the base body. An outer cover of the window/door securing device can equally be clipped onto the base body separately from or together with the actuation mechanism. The base body generally preferably has a hard metal as the material. The actuation mechanism and/or the outer cover can in contrast comprise a plastic as the material. Provision can be made on the installation of the window/door securing device that the base body is first fastened to the frame and the actuation mechanism and/or the outer cover is/are subsequently clipped onto the base body.

In accordance with an advantageous embodiment, the counter-piece has a latch section that cooperates with the base body for latching the counter-piece to the base body and that is configured as an eyelet. Such an eyelet can then in particular be simply engaged behind by a latch provided at the base body to latch the counter-piece to the base body in that the latch is led through the eyelet. A configuration of the latch section as an eyelet is comparatively simple from a design aspect, but simultaneously enables a stable latching in this respect.

The counter-piece preferably has a T shape having a shaft and a crossbar, with the shaft of the T shape or a part of the shaft forming a latch section cooperating with the base body for latching the counter-piece to the base body, and with the crossbar of the T shape having a contact surface for fastening the counter-piece to the leaf. Such a counter-piece can be particularly compact, e.g. in that the shaft and the crossbar of the T shape are each formed as areal sections. The shaft can, as generally described above for a latch section of the counter-piece, be configured as an eyelet or can comprise an eyelet so that it can cooperate with a latch at the base body. The contact surface preferably has one or more screw leadthroughs, in particular one respective screw leadthrough at both limbs of the crossbar, so that the counter-piece can be fastened to the leaf by means of screws guided through the screw leadthroughs. Since the function of the counter-piece can be restricted to being fixedly fastenable to the leaf, and to providing a latch section for latching to the base body, the counter-piece can be very compact so that the shaft and the crossbar of the T shape are only very short.

The counter-piece can, for example, be configured as a single-part lost wax casting. Alternatively, the counter-piece can also have a base plate, e.g. a metal sheet, that can form the contact surface of the counter-piece or the crossbar of the T shape and can be connected to a component that is (at least initially) separate, for example, a short tube piece, that then forms the latch section or the shaft of the T shape, e.g. by means of welding, screwing, riveting or plugging into one another.

In accordance with an advantageous embodiment, the counter-piece is, however, at least in two parts and comprises two angular elements, in particular angular metal sheets, preferably of the same construction, each having two limbs aligned perpendicular to one another, wherein the angular elements are each partly incised at the edge at which the two respective limbs intersect so that the angular elements can be plugged into one another such that the two angular elements form a T shape together, wherein a limb of the one angular element and a limb of the other angular element contact one another and form the shaft of the T shape and the two remaining limbs form the two limbs of the crossbar of the T shape. Such a counter-piece can be produced particularly simply and inexpensively, in particular when the two angular elements are of the same construction, but in so doing has a comparability high stability and bending stiffness under tensile loading since the two angular elements catch in one another under tension.

In accordance with a further advantageous embodiment, the window/door securing device comprises a fastening means for fastening the counter-piece to the leaf that comprises a base section, at least one prolongation that extends away from the base section, that is in particular pin-shaped, and that is preferably configured in the form of a threaded sleeve or of a screw shaft, and a security against rotation, wherein the fastening means is configured to be arranged with the base section at a side of the leaf and to extend with the prolongation so far into the leaf or through the leaf that the counter-piece can be connected to the prolongation at the opposite side of the leaf and can in so doing be secured against a rotation by the security against rotation. Said sides of the leaf are in particular the inner side and the outer side respectively of the leaf. The base section is in this respect preferably arranged at the outer side of the leaf so that the counter-piece can be fastened to the inner side of the leaf.

It is in particular prevented by the security against rotation that the fastening means can rotate about said prolongation in the assembled state. This is in particular important on a configuration of the prolongation as a threaded sleeve, as a screw shaft, or as another element having an internal or external thread that is connected to the counter-piece by a screw connection so that said screw connection cannot be released from the side of the base section. The security against rotation is preferably configured as at least one further prolongation, in particular a pin-shaped prolongation, that extends away from the base section and that likewise extends into the leaf. Such a prolongation is thus not accessible from the side of the base section, but blocks a rotation of the fastening means about the other prolongation.

The further prolongation can serve only for the security against rotation and can be configured for this purpose generally completely differently, in particular also substantially shorter, than the other prolongation serving for the connection with the counter-piece. The further prolongation can, for example, be formed only by a short tooth-like projection. The further prolongation can alternatively, however, also be configured in a very similar manner to the other prolongation and can likewise extend so far into the leaf or through the leaf that the counter-piece can also be connected to the further prolongation. For this purpose, the further prolongation can also have a thread and can in particular be formed in the manner of a threaded sleeve or of a screw shaft.

Independently of the configuration of the base body, in particular independently of the arrangement of respective installation surfaces of the base body, the invention also relates to a window/door securing device for securing a leaf, in particular an outwardly opening leaf, of a window or of a door in a closed position in which the leaf contacts a frame of the window or door, wherein the window/door securing device comprises a base body and a counter-piece that is selectively latchable to the base body so that, on a fastening of the base body to the leaf and of the counter-piece to the frame or conversely of the base body to the frame and of the counter-piece to the leaf, the leaf can be secured in the closed position by latching the counter-piece to the base body, wherein the counter-piece comprises two angular elements, in particular angular metal sheets, preferably of the same construction, each having two limbs aligned at an angle of 90° with respect to one another, wherein the angular elements are each partly incised at the edge at which the two respective limbs impact one another so that the angular elements can be plugged into one another such that the two angular elements together have a T shape, and wherein a limb of the one angular element and a limb of the other angular element contact one another and form the shaft of the T shape and the two other limbs forms the two limbs of the crossbar of the T shape.

Independently of the configuration of the base body, in particular independently of the arrangement of respective installation surfaces of the base body, the invention furthermore also relates to a window/door securing device for securing a leaf, in particular an outwardly opening leaf, of a window or door in a closed position in which the leaf contacts a frame of the window or door, wherein the window/door securing device comprises a base body and a counter-piece that is selectively latchable to the base body so that, on a fastening of the base body to the leaf and of the counter-piece to the frame or conversely of the base body to the frame and of the counter-piece to the leaf, the leaf can be secured in the closed position by latching the counter-piece to the base body, wherein the window/door securing device comprises a fastening means for fastening the counter-piece or the base body to the leaf that comprises a base section, at least one prolongation that extends away from the base section, that is in particular of pin shape, and that is preferably configured in the form of a threaded sleeve or of a screw shaft, and a security against rotation, wherein the fastening means is configured to be arranged with the base section at a side of the leaf and to extend with the prolongation so far into the leaf or through the leaf that the counter-piece or the base body can be connected to the prolongation at the opposite side of the leaf and in so doing can be secured against rotation by the security against rotation, and wherein the security against rotation is preferably configured as at least one further prolongation that extends away from the base section, that is in particular of pin shape, and that likewise extends into the leaf.

FIGURES

The invention will be described in more detail in the following only by way of example with reference to the Figures.

FIGS. 1 and 2 show in perspective representations an embodiment of the window/door securing device in accordance with the invention in two different positions of a latch of the window/door securing device;

FIG. 3 shows the embodiment shown in FIGS. 1 and 2 without a cover;

FIG. 4 shows the embodiment shown in FIGS. 1 and 2 in a side view;

FIG. 5 shows in a perspective representation an alternative embodiment of the window/door securing device in accordance with the invention without a lock cylinder;

Figure 7:
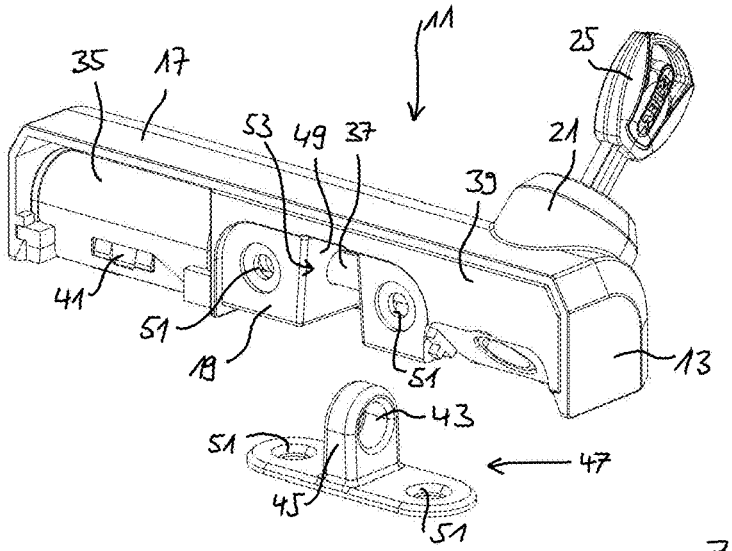
Figure 8:
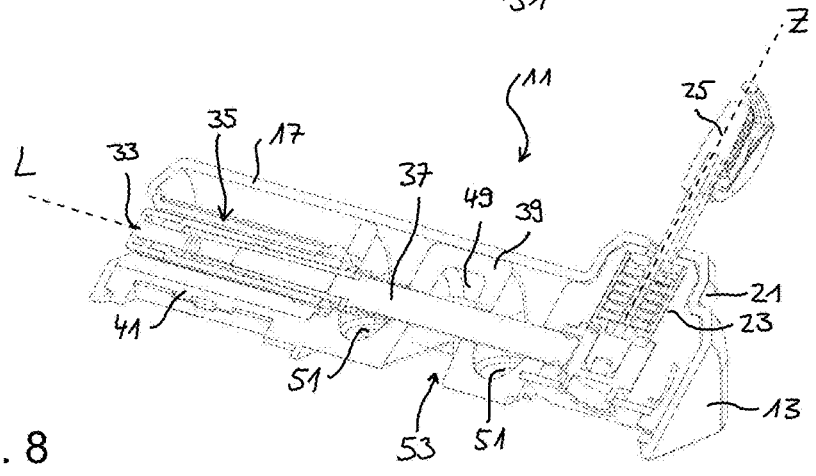
Figure 9:
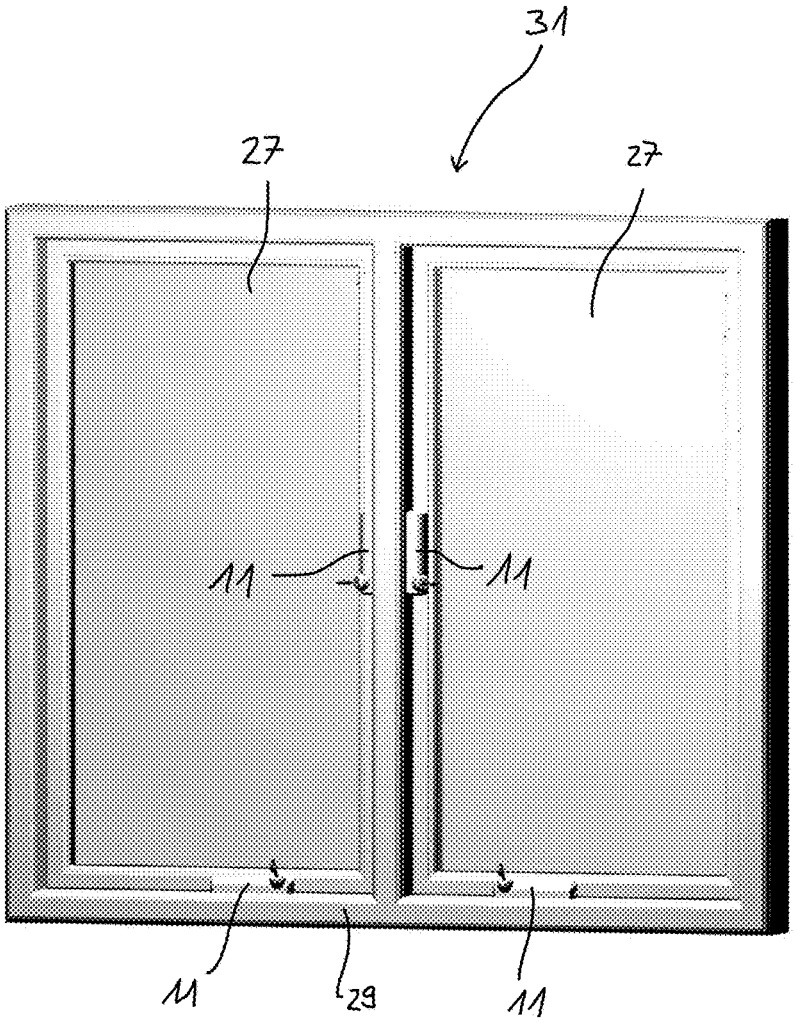
Figure 10:
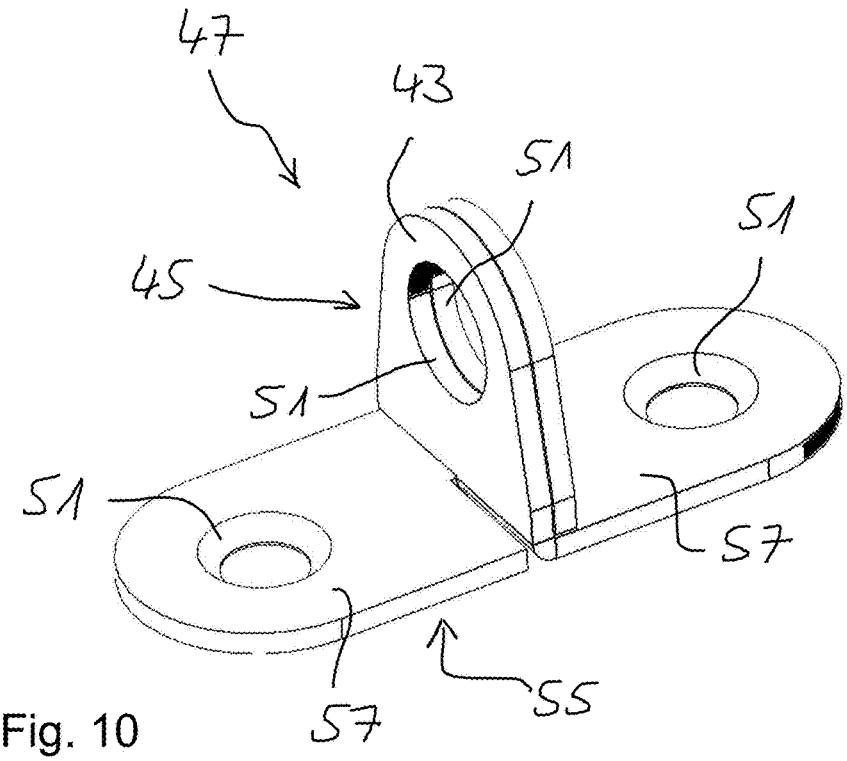
Figure 11:
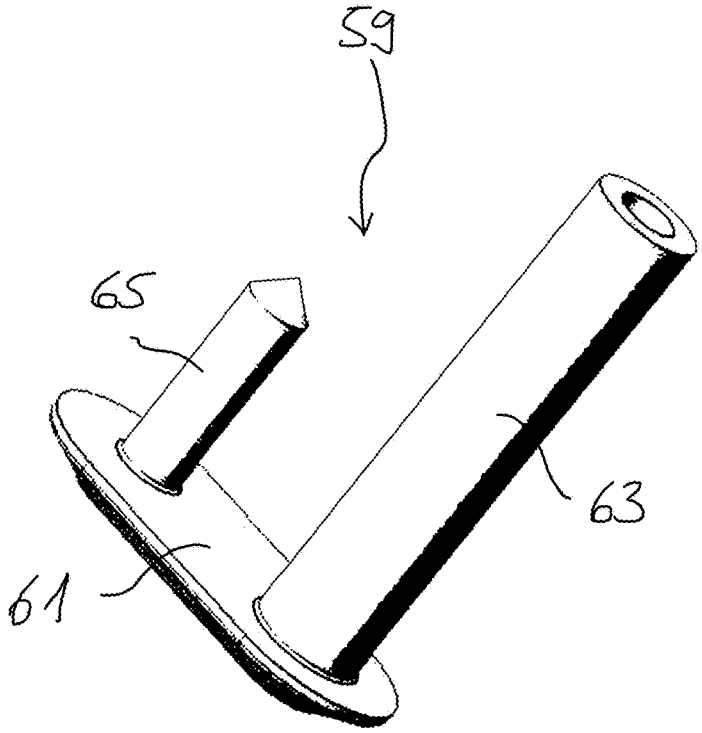

FIG. 8 substantially corresponds to FIG. 7, with the window/door securing device being shown in section;

FIG. 9 shows an arrangement of four window/door securing devices at a window;

FIG. 10 shows an alternative embodiment of the counter-piece of a window/door securing device in accordance with the invention; and FIG. 11 shows a fastening means of an embodiment of a window/door securing device in accordance with the invention.

DETAILED DESCRIPTION

The embodiments of a window/door securing device 11 in accordance with the invention shown in the Figures each have an elongate shape that extends along a longitudinal axis L and is outwardly bounded by a cover 17 at the two front sides 13 of its longitudinal extent and at the side surfaces 15, 15' visible in FIGS. 1 and 2. Whereas the transition between the two side surfaces 15, 15' covered by the cover 17 is rounded, the transitions to the two further side surfaces 19, 19', that cannot be seen in FIGS. 1 and 2, and the transition between these two side surfaces 19, 19' are formed as right-angled edges. These non-covered side surfaces form installation surfaces 19, 19' of the window/door securing device 11 and are aligned perpendicular to one another and to the respective adjacent further side surface 15 and 15' respectively (cf. also the shape of the front side 13 and FIG. 4).

In the rounded transition between the side surfaces 15, 15', a cylindrical projection 21 extends in the cover 17 at an end of the longitudinal extent of the window/door securing device 11; it is aligned at an angle of 45° to the two installation surfaces 19, 19' and accommodates a lock cylinder 23 (cf. FIG. 3 in which the window/door securing device 11 is shown without the cover 17). The lock cylinder 23 is here aligned such that its cylinder axis Z is a bisectrix of the angle between the two installation surfaces 19, 19' (cf. also the sectional representation of FIG. 8 in whose sectional plane the longitudinal axis L and the cylinder axis Z are disposed). In this manner, a key 25 associated with the lock cylinder 23 is also easily accessible and actuable, when it is inserted into the lock cylinder 23, when the two installation surfaces 19, 19' of the window/door securing device 11 are arranged at a narrow angle between a leaf 27 and a frame 29 of a window 31 (cf. FIG. 9) or door.

An actuation element 33 that is part of an actuation mechanism (cf. in particular FIG. 8) by means of which a latch 37 can be moved between a latching position and a release position is provided at the window/door securing device 11 at the end of the longitudinal extent opposite the end with the lock cylinder 23. The actuating mechanism 35 in the embodiment shown is configured in the manner of a retractable ballpoint pen mechanism so that the latch 37 can be displaced like the ink cartridge of a retractable ballpoint pen by pressing the pin-shaped actuation element 33 that extends through an opening in the front side 13 (cf. FIGS. 1 and 2).

The embodiment of FIGS. 1 and 2 is shown in FIG. 3 without the cover 17 and without an inserted key 25. The base body 39 is an essential element of the window/door securing device 11; it is particularly stable and is produced from metal, e.g. as a casting, while the cover and the actuation mechanism are preferably at least substantially produced from plastic. The base body 39 is shaped such that the lock cylinder 23 can be inserted perpendicular to the longitudinal axis L and the latch 37 is movably supported along the longitudinal axis L in the base body 39. The actuation mechanism 35 is clipped to a web 41 of the base body 39. The cover 17 can be simply latchingly placed onto the base body 39. The window/door securing device 11 can thus be assembled comparatively simply, with the base body 39 representing the substantially bearing structure of the window/door securing device 11. The installation surfaces 19, 19' are additionally defined by the base body 39 as will be explained in more detail with respect to FIGS. 6 to 8.

Two different positions of the actuation element 33 are shown in FIGS. 1 and 2. The position shown in FIG. 1 in which the actuation element 33 ends flush with the front side 13 corresponds to a latching position of the latch 37 in which it engages behind a latch section 45 of a counter-piece 47 that is formed as an eyelet 43 and that extends into a receiver 49 within the base body 39 of the window/door securing device 11 when the leaf 27 to be secured is closed (cf. also FIGS. 6 to 8). In this manner, the counter-piece 47 is latched to the base body 39 by the latch 37 in the latching position, whereby the leaf 27 is then secured in its closed position. The position of the actuation element 33 which is shown in FIG. 2 and in which it projects a lot out of the front side 13 in contrast corresponds to the release position of the latch 37 in which the latch 37 is led out of the eyelet 43 and the counter-piece 47 can therefore be released from the base body 39 so that the leaf 27 can be opened.

A further latching position in which the actuation element 33 only projects slightly over the front side 13 can be provided between the two shown positions. The latch 37 also projects through the eyelet 43 in this further latching position so that the counter-piece 47 is latched to the base body 39 and the leaf 27 is thus secured in the closed position. The actuation mechanism 35 can then be active between the release position and this further latching position in the manner of a retractable ballpoint pen, with the latching position shown in FIG. 1 being achieved in that the actuation element 33 is pressed beyond the further latching position completely into the front side 13. In this position, the latch 37 is then held in cooperation with the lock cylinder 23 by which it is blocked against a departure from the latching position. For this purpose, for example, a ring groove of the latch 37 is engaged behind by a blocking element cooperating with the lock cylinder 23, as is shown in the sectional representation of FIG. 8. The latch 37 can therefore only moved out of the latching position corresponding to that of FIG. 1 into the release position when the lock cylinder 23 is actuated by the associated key 25. The window/door securing device 11 is thus additionally secured against unauthorized unlatching by this blockable latching position.

FIG. 5 shows an alternative embodiment of the window/door securing device 11 that has no lock cylinder 23. The adjustment of the latch 37 here takes place only by actuation of the actuation element 33. A further latching position is not provided in this embodiment. The latch 37 can rather only be adjusted by the actuation mechanism 35 between two defined positions, namely a release position and a latching position (not additionally blockable) that corresponds to the position shown in FIG. 5. As long as such a window/door securing device 11 is not accessible for an intruder, a leaf 27 can also be reliably secured in its closed position by means of such a window/door securing device 11 that is not additionally blockable.

Figure 6:
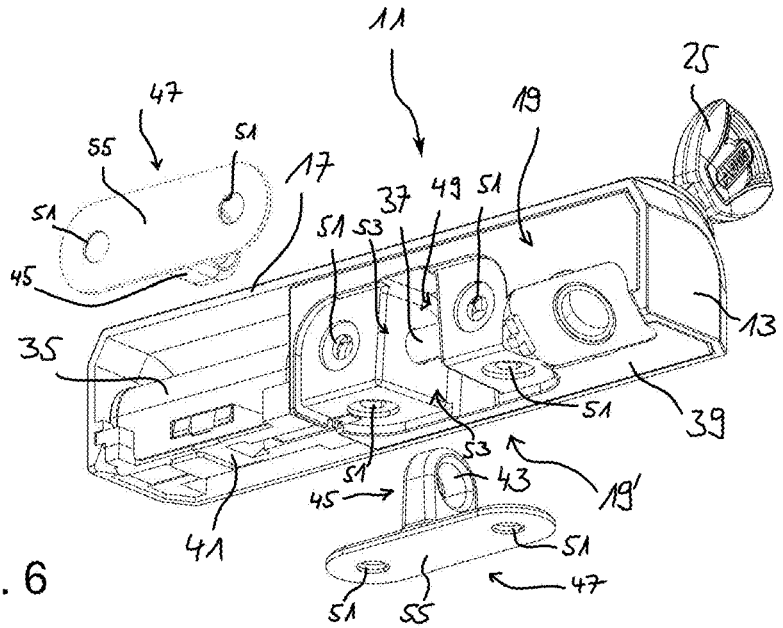
FIGS. 6 and 7 show in perspective representations the embodiment shown in FIGS. 1 and 2 from further viewing directions and with a separate counter-piece.

The embodiment of the window/door securing device 11 shown in FIGS. 1 to 4 is shown from further angles of view in FIGS. 6 to 8 so that in particular the installation surfaces 19, 19' can be seen. The installation surfaces 19, 19' are primarily defined by corresponding surfaces of the base body 39. Since the cover 17 also covers the actuation mechanism 35 in an extension of the base body 39, the surface enlarged by this extension can also be considered as a respective installation surface 19, 19' so that the base body 39 and the cover 17 together define the installation surfaces 19, 19'.

The two installation surfaces 19, 19' are at least substantially flat to be able to contact the leaf 27 or the frame 29 of a window 31 or door. In addition, two respective screw leadthroughs 51 are formed in both installation surfaces 19, 19' at the base body 39 so that the base body 39 and the elements connected thereto can be screwed to the frame 29 via one of the installation surfaces 19, 19'. The counter-piece 47 in contrast is fastened to the leaf 27.

A respective receiver opening 53 through which the latch section 45 of the counter-piece 47 can move into the receiver 49 centrally formed in the base body 39 is provided between the two screw leadthroughs 51 of a respective installation surface 19, 19'. The two receiver openings 53 of the two installation surfaces 19, 19' merge into one another so that they form a single receiver opening 53.

As a result of the configuration of the installation surfaces 19, 19' symmetrically to one another, above all with respect to the position of their screw leadthroughs 51 and their receiver opening 53, a free selection can be made as to with which installation surface 19, 19' the base body 39 should cooperate with the leaf 27 and with which it should cooperate with the frame 29. For both installation surfaces 19, 19' are equally suitable for fastening the base body 39 via screws led through the screw leadthroughs 51 and for receiving the latch section 45 of the counter-piece 47 through the receiver opening 53 into the receiver 49. The counter-piece 47 is therefore not only shown in a position in FIG. 6, as in FIG. 7, from where it can cooperate via the lower installation surface 19' with the base body 39, but additionally (chain-dotted) also at a further position from where it can equally reliably cooperate with the base body 39 via the front installation surface 19. A particularly flexible arrangement of the window/door securing device 11 is thus possible at different positions and in different alignments, also only with a small amount of available space. This is illustrated by FIG. 9 in which four window/door securing devices 11 are arranged at an outwardly opening double-leaf window 31 to be able to secure the two leaves 27 contacting the frame 29 in their respective closed positions against opening.

FIGS. 6 and 7 show a possible embodiment of the counter-piece 47 in which the counter-piece 47 has a T shape at whose shaft the latch section 45 is configured with the eyelet 43 and whose crossbar forms a contact surface 55 having two screw leadthroughs 51. In this manner, the contact surface 55 of the counter-piece 47 can be reliably screwed to the leaf 27, can have a projecting latch section 45 that is fastened in a stable manner, and can simultaneously be of very compact design. In the embodiment shown in FIGS. 6 and 7, the counter-piece 47 is formed as a single-part lost wax casting. An alternative embodiment to this is shown in FIG. 10.

The basic structure of the embodiment of the counter-piece 47 shown in FIG. 10 in this respect corresponds to that of the embodiment shown in FIGS. 6 and 7. The counter-piece 47 in turn has a T shape having a latch section 45 and a contact surface 55. The counter-piece 47 is, however, formed in two pieces and comprises two right-angle angular elements 57 of the same construction. The angular elements 57 are each incised down to the center at the edge at which the limbs of a respective angular element 57 are adjacent to one another so that the angular elements 57 can, as shown, be plugged into one another and the counter-piece 47 thus formed then has a T shape. The shaft of the T shape is in this respect formed by two mutually contacting limbs that are part of a respective different angular element 57. Since the limbs of both angular elements 57 each have a screw leadthrough 51, the mutually contacting limbs can together form the latch section 45 (advantageously reinforced by a double thickness) with an eyelet 43, while the two remaining limbs are aligned in a plane and together form the contact surface 55 having two screw leadthroughs 51 for fastening the counter-piece 47 to the leaf 27.

The counter-piece 47 can generally be simply screwed into the leaf frame of the leaf 27. A more stable fastening results, however, when an additional fastening means 59 is provided that extends through the leaf frame. A possible embodiment of such a fastening means 59 is shown in FIG. 11. The fastening means has a base section 61 from where a pin-like prolongation 63 extends that is configured as a threaded sleeve having an internal thread. The prolongation 63 of the fastening means 59 can then be led through the leaf frame of the leaf 27 to fasten the counter-piece 47 by means of a screw that is screwed into the prolongation 63. Depending on the length of the screw, the prolongation does not have to extend completely through the leaf frame here. If the counter-piece 47 is to be fastened by means of a plurality of screws, the fastening means 59 can also have further corresponding prolongations 63, in particular equally configured as threaded sleeves. Since then a plurality of prolongations 63 extend through the leaf frame, the fastening means 59 is thereby secured against rotation so that the screw connection cannot be unscrewed from that leaf side which the base section 61 contacts.

However, even if the counter-piece 47 is only connected to the fastening means 59 via one screw connection, it can be secured against rotation. For this purpose, as in the embodiment shown in FIG. 11, a security against rotation 65 can be configured in the form of a further pin-shaped prolongation at the base section 61. This further prolongation 65 then does not have to have any thread and can be substantially shorter than the prolongation 63 cooperating with the counter-piece 47. For it is sufficient that the further projection 65 engages into the leaf frame to act as a security against rotation 65 for the fastening means 59.

The invention claimed is:

1. A window/door securing device (11) for securing a leaf (27) of a window (31) or door in a closed position in which the leaf (27) contacts a frame (29) of the window (31) or door, wherein the window/door securing device (11) comprises a base body (39) and a counter-piece (47) that is selectively latchable to the base body (39) so that on a fastening of the base body (39) to the frame (29) and of the counter-piece (47) to the leaf (27), the leaf (27) can be secured in the closed position by latching the counter-piece (47) to the base body (39);

wherein the base body (39) has two installation surfaces (19, 19'), wherein only one of the installation surfaces (19, 19') of the base body (39) is selectively placed on and fastened to the frame (29) at a time, the other of the installation surfaces cooperating with the counter-piece;

and wherein the two installation surfaces (19, 19') are aligned perpendicular to one another.

2. A window/door securing device in accordance with claim 1, wherein the two installation surfaces (19, 19') are adjacent to one another.

3. A window/door securing device in accordance with claim 1, wherein the two installation surfaces (19, 19') each have at least one screw leadthrough (51) through which a respective screw can be led for fastening the base body (39) to the frame (29).

4. A window/door securing device in accordance with claim 1, wherein the base body (39) is configured to be used as a drill template for the fastening of the counter-piece (47) to the leaf (27) in the state in which the base body (39) is fastened to the frame (29).

5. A window/door securing device in accordance with claim 4, wherein the two installation surfaces (19, 19') of the base body (39) each have at least one screw leadthrough (51) through which a respective screw can be led for fastening the base body (39) to the frame (29);

wherein the counter-piece (47) has at least one screw leadthrough (51) through which a respective screw can be led for fastening the counter-piece (47) to the leaf (27);

and wherein the arrangement of the at least one screw leadthrough (51) of the counter-piece (47) is the same as the arrangement of the at least one screw leadthrough (51) of each of the two installation surfaces (19, 19') of the base body (39).

6. A window/door securing device in accordance with claim 1, wherein the base body (39) has a receiver (49) for receiving a latch section (45) of the counter-piece (47).

7. A window/door securing device in accordance with claim 6, wherein the two installation surfaces (19, 19') of the base body (39) each have a receiver opening (53) through which the latch section (45) of the counter-piece (47) can penetrate into the receiver (49).

8. A window/door securing device in accordance with claim 7, wherein the two installation surfaces (19, 19') of the base body (39) each have at least two screw leadthroughs (51) through which a respective screw can be led for fastening the base body (39) to the frame (29); and wherein the receiver opening (53) of each installation surface (19, 19') is arranged between the at least two screw leadthroughs (51) of the respective installation surface (19, 19').

9. A window/door securing device in accordance with claim 7, wherein the receiver opening (53) of the other one of the two installation surfaces (19, 19') of the base body (39) is exposed when one of the two installation surfaces (19, 19') of the base body (39) is fastened to the frame (29).

10. A window/door securing device in accordance with claim 1, wherein the two installation surfaces (19, 19') of the base body (39) are configured symmetrically to one another.

11. A window/door securing device in accordance with claim 10, wherein the two installation surfaces (19, 19') of the base body (39) each have at least one screw leadthrough (51) through which a respective screw can be led for fastening the base body (39) to the frame (29); and wherein the two installation surfaces (19, 19') of the base body (39) are configured symmetrically to one another with respect to the position of the respective at least one screw leadthrough (51) of the two installation surfaces (19, 19').

12. A window/door securing device in accordance with claim 10, wherein the base body (39) has a receiver (49) for receiving a latch section (45) of the counter-piece (47);

wherein the two installation surfaces (19, 19') of the base body (39) each have a receiver opening (53) through which the latch section (45) of the counter-piece (47) can penetrate into the receiver (49); and wherein the two installation surfaces (19, 19') of the base body (39) are configured symmetrically to one another with respect to the position of the respective receiver opening (53) of the two installation surfaces (19, 19').

13. A window/door securing device in accordance with claim 1, wherein the window/door securing device (11) comprises a latch (37) which is movably supported at the base body (39) between a release position and a latching position and via which the counter-piece (47) can be latched to the base body (39).

14. A window/door securing device in accordance with claim 13, wherein the base body (39) comprises a receiver (49);

wherein the counter-piece (47) comprises a latch section (45); and wherein, for latching the counter-piece (47) to the base body (39) in the closed position of the leaf (27), the latch section (45) of the counter-piece (47) is received in the receiver (49) of the base body (39) and the latch (37) blocks the latch section (45) of the counter-piece (47) in the receiver (49) in the latching position.

15. A window/door securing device in accordance with claim 13, wherein the latch (37) is aligned and/or movable in parallel with the two installation surfaces (19, 19') of the base body (39).

16. A window/door securing device in accordance with claim 13 wherein the two installation surfaces (19, 19') of the base body (39) each have at least one screw leadthrough (51) through which a respective screw can be led for fastening the base body (39) to the frame (29); and wherein the latch (37) is arranged in the latching position such that it blocks the respective screw, which is led through the at least one screw leadthrough (51) of one of the installation surfaces (19, 19'), against a release.

17. A window/door securing device in accordance with claim 13, wherein the window/door securing device (11) comprises a locking mechanism (23) that is arranged at the base body (39) and is configured to selectively block the latch (37) in the latching position against a movement into the release position.

18. A window/door securing device in accordance with claim 17, wherein the locking mechanism comprises a lock cylinder (23) whose cylinder axis (Z) is aligned at an angle of 45° to the two installation surfaces (19, 19') of the base body (39).

19. A window/door securing device in accordance with claim 18, wherein the lock cylinder (23) has disk tumblers.

20. A window/door securing device in accordance with claim 13, wherein the window/door securing device (11) has an actuation mechanism (35) via which the latch (37) is displaceable in the manner of the ink cartridge of a retractable ballpoint pen.

21. A window/door securing device in accordance with claim 1, wherein the counter-piece (47) has a latch section (45) that cooperates with the base body (39) for latching the counter-piece (47) to the base body (39) and that is configured as an eyelet (43).

22. A window/door securing device in accordance with claim 1, wherein the counter-piece (47) has a T shape having a shaft and a crossbar;

wherein the shaft or a part of the shaft forms a latch section (45) which cooperates with the base body (39) for latching the counter-piece (47) to the base body (39);

and wherein the crossbar of the T shape has a contact surface (55) for fastening the counter-piece (47) to the leaf (27).

23. A window/door securing device in accordance with claim 1, wherein the counter-piece (47) comprises two angular elements (57) having two respective limbs aligned perpendicular to one another;

and wherein the angular elements (57) are each partly incised such that the angular elements (57) can be plugged into one another such that the two angular elements (57) together have a T shape, with one limb of the one angular element (57) and one limb of the other angular element (57) contacting one another and forming the shaft of the T shape and with the two other limbs forming the two limbs of the crossbar of the T shape.

24. A window/door securing device in accordance with claim 1, wherein the window/door securing device (11) comprises a fastening means (59) for fastening the counter-piece (47) to the leaf (27), the fastening means (59) having a base section (61), at least one prolongation (63) that extends away from the base section (61), and a security against rotation (65);

wherein the fastening means (59) is configured to be arranged with the base section (61) at a side of the leaf (27) and to extend with the prolongation (63) so far into the leaf (27) or through the leaf (27) that the counter-piece (47) can be connected to the prolongation (63) at an opposite side of the leaf (27) and in so doing is secured against a rotation by the security against rotation (65).

25. A window/door securing device (11) for securing a leaf (27) of a window (31) or door in a closed position in which the leaf (27) contacts a frame (29) of the window (31) or door, wherein the window/door securing device (11) comprises a base body (39) and a counter-piece (47) that is selectively latchable to the base body (39) so that on a fastening of the base body (39) to the frame (29) and of the counter-piece (47) to the leaf (27), the leaf (27) can be secured in the closed position by latching the counter-piece (47) to the base body (39);

wherein the base body (39) has two installation surfaces (19, 19') so that one of the installation surfaces (19, 19') of the base body (39) can be selectively placed on and fastened to the frame (29);

wherein the two installation surfaces (19, 19') are aligned perpendicular to one another;

wherein the base body (39) has a receiver (49) for receiving a latch section (45) of the counter-piece (47) and wherein the two installation surfaces (19, 19') of the base body (39) each have a receiver opening (53) through which the latch section (45) of the counter-piece (47) can penetrate into the receiver (49).

26. A window/door securing device in accordance with claim 25, wherein the two installation surfaces (19, 19') of the base body (39) each have at least two screw leadthroughs (51) through which a respective screw can be led for fastening the base body (39) to the frame (29); and wherein the receiver opening (53) of each installation surface (19, 19') is arranged between the at least two screw leadthroughs (51) of the respective installation surface (19, 19').

27. A window/door securing device in accordance with claim 25, wherein the receiver opening (53) of the other one of the two installation surfaces (19, 19') of the base body (39) is exposed when one of the two installation surfaces (19, 19') of the base body (39) is fastened to the frame (29).

28. A window/door securing device in accordance with claim 25, wherein the two installation surfaces (19, 19') of the base body (39) are configured symmetrically to one another with respect to the position of the respective receiver opening (53) of the two installation surfaces (19, 19').

29. A window/door securing device (11) for securing a leaf (27) of a window (31) or door in a closed position in which the leaf (27) contacts a frame (29) of the window (31) or door, wherein the window/door securing device (11) comprises a base body (39) and a counter-piece (47) that is selectively latchable to the base body (39) so that on a fastening of the base body (39) to the frame (29) and of the counter-piece (47) to the leaf (27), the leaf (27) can be secured in the closed position by latching the counter-piece (47) to the base body (39);

wherein the base body (39) has two installation surfaces (19, 19') so that one of the installation surfaces (19, 19') of the base body (39) can be selectively placed on and fastened to the frame (29);

wherein the two installation surfaces (19, 19') are aligned perpendicular to one another;

wherein the window/door securing device (11) comprises a latch (37) which is movably supported at the base body (39) between a release position and a latching position and via which the counter-piece (47) can be latched to the base body (39) and wherein the latch (37) is aligned and/or movable in parallel with the two installation surfaces (19, 19') of the base body (39).

30. A window/door securing device (11) for securing a leaf (27) of a window (31) or door in a closed position in which the leaf (27) contacts a frame (29) of the window (31) or door, wherein the window/door securing device (11) comprises a base body (39) and a counter-piece (47) that is selectively latchable to the base body (39) so that on a fastening of the base body (39) to the frame (29) and of the counter-piece (47) to the leaf (27), the leaf (27) can be secured in the closed position by latching the counter-piece (47) to the base body (39);

wherein the base body (39) has two installation surfaces (19, 19') so that one of the installation surfaces (19, 19') of the base body (39) can be selectively placed on and fastened to the frame (29);

wherein the two installation surfaces (19, 19') are aligned perpendicular to one another;

wherein the base body (39) is configured to be used as a drill template for the fastening of the counter-piece (47) to the leaf (27) in the state in which the base body (39) is fastened to the frame (29);

wherein the two installation surfaces (19, 19') of the base body (39) each have at least one screw leadthrough (51) through which a respective screw can be led for fastening the base body (39) to the frame (29);

wherein the counter-piece (47) has at least one screw leadthrough (51) through which a respective screw can be led for fastening the counter-piece (47) to the leaf (27);

and wherein the arrangement of the at least one screw leadthrough (51) of the counter-piece (47) is the same as the arrangement of the at least one screw leadthrough (51) of each of the two installation surfaces (19, 19') of the base body (39).

31. A window/door securing device (11) for securing a leaf (27) of a window (31) or door in a closed position in which the leaf (27) contacts a frame (29) of the window (31) or door, wherein the window/door securing device (11) comprises a base body (39) and a counter-piece (47) that is selectively latchable to the base body (39) so that on a fastening of the base body (39) to the frame (29) and of the counter-piece (47) to the leaf (27), the leaf (27) can be secured in the closed position by latching the counter-piece (47) to the base body (39);

wherein the base body (39) has two installation surfaces (19, 19') so that one of the installation surfaces (19, 19') of the base body (39) can be selectively placed on and fastened to the frame (29);

wherein the two installation surfaces (19, 19') are aligned perpendicular to one another;

wherein the window/door securing device (11) comprises a latch (37) which is movably supported at the base body (39) between a release position and a latching position and via which the counter-piece (47) can be latched to the base body (39);

wherein the window/door securing device (11) comprises a locking mechanism (23) that is arranged at the base body (39) and is configured to selectively block the latch (37) in the latching position against a movement into the release position;

wherein the locking mechanism comprises a lock cylinder (23) whose cylinder axis (Z) is aligned at an angle of 45° to the two installation surfaces (19, 19') of the base body (39).

32. A window/door securing device in accordance with claim 31, wherein the lock cylinder (23) has disk tumblers.

* * * * *